United States Patent [19]

Shaw

[11] Patent Number: 5,065,591

[45] Date of Patent: Nov. 19, 1991

[54] REFRIGERATION TEMPERATURE CONTROL SYSTEM

[75] Inventor: David N. Shaw, Syracuse, N.Y.

[73] Assignee: Carrier Corporation, Syracuse, N.Y.

[21] Appl. No.: 646,021

[22] Filed: Jan. 28, 1991

[51] Int. Cl.[5] ..... F25B 5/00

[52] U.S. Cl. ..... 62/175; 62/199; 62/217; 62/510

[58] Field of Search ..... 62/175, 510, 199, 200, 62/217, 196.2, 196.3, 228.3, 228.5, 226, 227, 229; 236/1 EA

[56] References Cited

U.S. PATENT DOCUMENTS 3,151,469 10/1964 Quick ..... 62/510 X 3,234,749 2/1966 Quick ..... 62/510 X 4,193,270 3/1980 Scott ..... 62/175

4,934,158 6/1990 Sakano ..... 62/196.2

*Primary Examiner*—Harry B. Tanner

[57] ABSTRACT

A refrigeration system includes a rack or bank of compressors located in parallel and feeding a common condenser. Liquid refrigerant from the condenser is supplied to a plurality of evaporators located in parallel and feeding a common suction manifold. The suction manifold is connected to the compressors and contains a valve for selectively isolating one or more compressors and evaporators whereby the isolated compressor acts as a satellite compressor and the isolated evaporators are operated at a lower temperature than the other evaporators.

3 Claims, 1 Drawing Sheet

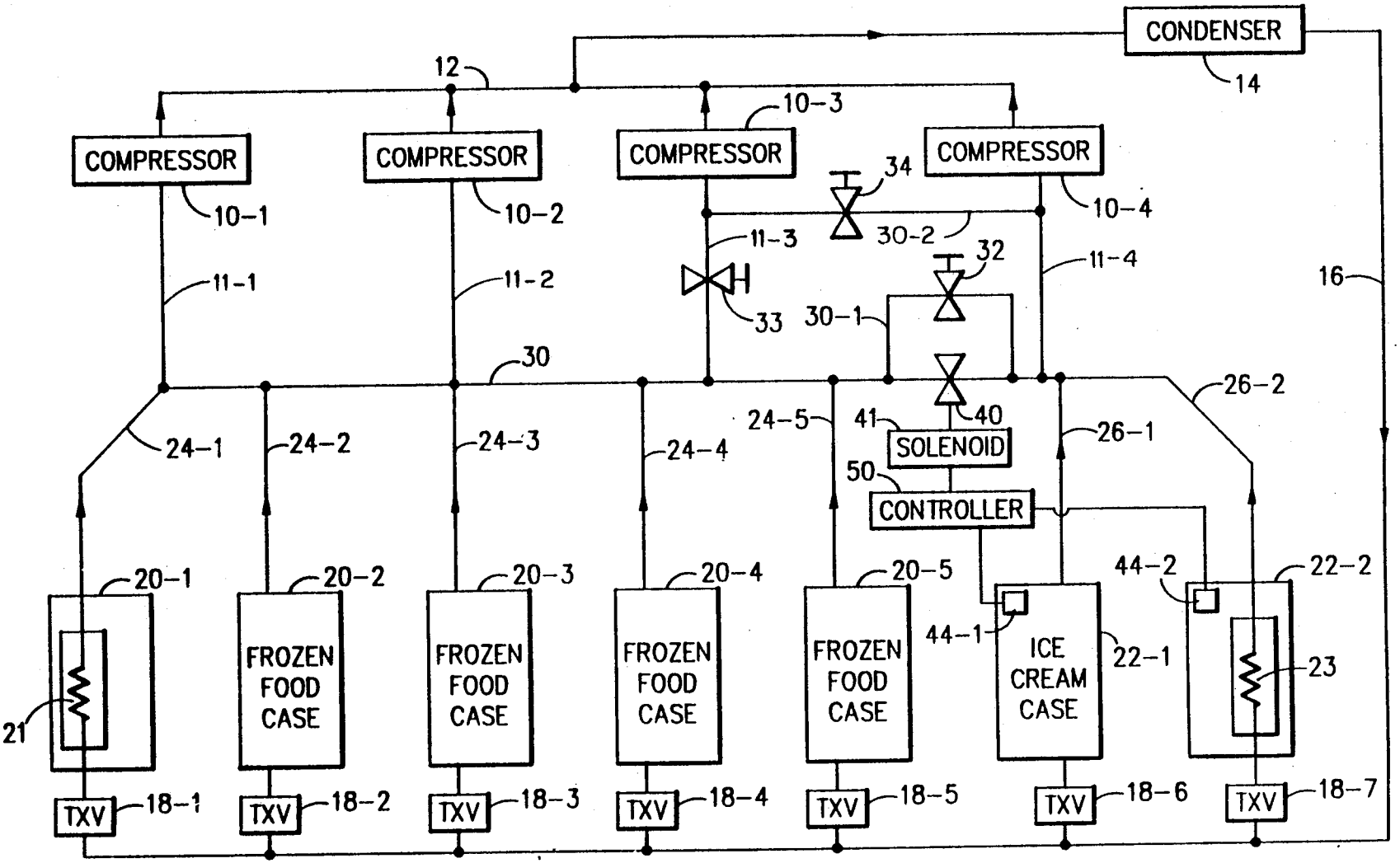
CONDENSER
14
16
COMPRESSOR
10-1
10-2
10-3
10-4
11-1
11-2
11-3
11-4
12
30
30-1
30-2
32
33
34
40
41
50
SOLENOID
CONTROLLER
26-1
26-2
24-1
24-2
24-3
24-4
24-5
20-1
20-2
20-3
20-4
20-5
FROZEN FOOD CASE
22-1
22-2
ICE CREAM CASE
23
21
44-1
44-2
TXV
18-1
18-2
18-3
18-4
18-5
18-6
18-7

REFRIGERATION TEMPERATURE CONTROL SYSTEM

BACKGROUND OF THE INVENTION

In commercial refrigeration systems such as are employed in supermarkets, the refrigeration system includes a bank or rack of compressors, a condenser and a plurality of evaporators in the various display cases. Ice cream is peculiar in that it must be kept colder than most other frozen foods or else the package will be "soft" to the touch and less salable. Of course, deep freezing is best for and does not hurt the product but maintaining an excess temperature reduction comes at a price. To achieve the 0° F. proper storage temperature for ice cream, a typical saturated suction temperature would be −35° F. whereas −25° F. would be satisfactory for other frozen foods. Thus, an individual compressor on the rack, called the satellite compressor, is normally used to refrigerate the ice cream. Specifically, all of the compressors in the rack use the same condenser, but the satellite compressor only receives suction vapor from the evaporator(s) in the ice cream display case(s). Upon failure of the satellite compressor, refrigeration is lost in the ice cream display case(s).

An alternative to the use of a satellite compressor is to place a pressure regulator at the outlet of each of the display cases except the ice cream case(s). All of the compressors would operate at −35° F. saturated suction temperature. This alternative is inefficient and complex.

SUMMARY OF THE INVENTION

A refrigeration system is provided with a rack of compressors connected to a common condenser and to a common suction manifold. The suction manifold is also connected to a number of evaporators located in display cases and in parallel fluid paths. A valve is located in the manifold for isolating one compressor and the evaporator(s) in the ice cream case(s) when the valve is closed so that the isolated compressor functions as a satellite compressor. The valve is thermostatically responsive to the temperature in one or more ice cream cases. When the thermostat is satisfied the valve is open and the compressor acts in concert with the other compressors in the bank and is connected to the common suction manifold. To prevent the compressor acting as a satellite compressor from taking its saturated suction temperature too low when acting as a satellite compressor, a valved bypass is provided around the valve. The valved bypass may be replaced with a bypass containing a downstream pressure regulator which opens responsive to too low of a pressure in the ice cream case evaporators.

It is an object of this invention to eliminate the need for a satellite compressor.

It is another object of this invention to provide a commercial refrigeration system having freezing compartments at different temperatures without the use of a satellite compressor. These objects, and others as will become apparent hereinafter, are accomplished by the present invention.

Basically, a refrigeration system includes a rack or bank of compressors located in parallel and feeding a common condenser. Liquid refrigerant from the condenser is supplied to a plurality of evaporators which are located in parallel via thermal expansion valves (TXVs). The gaseous refrigerant passing through the evaporators passes into a suction manifold supplying all of the compressors in the bank. A valve is provided in the suction manifold for selectively isolating all of the evaporators operating at the coldest temperature and an associated compressor from the other evaporators and compressors responsive to a thermostatic sensor. In a preferred embodiment there is a restricted bypass of the valve for preventing the selectively isolated compressor from operating at too low of a saturated suction temperature.

BRIEF DESCRIPTION OF THE DRAWING

For a fuller understanding of the present invention, reference should now be made to the following detailed description thereof taken in conjunction with the accompanying drawing wherein:

The FIGURE is a schematic representation of a commercial refrigeration system employing the present invention.

DESCRIPTION OF THE PREFERRED EMBODIMENT

In the Figure, compressors 10-1 to 10-4 comprise a bank or rack and discharge into common discharge manifold 12 which is connected to the inlet of condenser 14. Liquid refrigerant passes from condenser 14 via line 16 and this flow is divided and supplied to frozen food cases 20-1 to 20-5 and ice cream cases 22-1 and 22-2 via thermal expansion valves (TXVs) 18-1 to 18-7, respectively. Each of the frozen food cases and ice cream cases contains an evaporator as exemplified by evaporator 21 of frozen food case 20-1 and evaporator 23 of ice cream case 22-2. Refrigerant from the evaporators in the frozen food cases 20-1 to 20-5 and ice cream cases 22-1 and 22-2 is supplied via lines 24-1 to 24-5 and 26-1 and 26-2 to common suction manifold 30. Refrigerant is drawn from suction manifold 30 into whichever ones of compressors 10-1 to 10-4 are working via their corresponding suction lines 11-1 to 11-4. Compressors 10-1 to 10-4 may be of different sizes and are operated responsive to demand, as in conventional, but compressor 10-4 would preferably be the last one shut off. The ice cream cases 22-1 and 22-2 must be kept at a lower temperature than is necessary in frozen food cases 20-1 to 20-5. To permit the ice cream cases 22-1 and 22-2 to be held to the lower temperature, valve 40 is located in suction manifold 30 so as to selectively isolate compressor 10-4 to permit it to function as a satellite compressor with respect to the evaporators of ice cream cases 22-1 and 22-2. Valve 40 is controlled by controller 50 through solenoid 41. Controller 50 which may be a microprocessor or any other suitable device receives temperature information from thermostats 44-1 and 44-2 in ice cream cases 22-1 and 22-2, respectively.

Because compressor 10-4 acts as part of the compressor bank as well as functioning as a satellite compressor its sizing is such that it might achieve too low of a saturated suction temperature. To avoid this problem a bypass line 30-1 is provided around valve 40. The bypass line 30-1 is restricted, preferably by a hand operated valve 32, as illustrated. The opening of valve 32 will be manually adjusted while compressor 10-4 is running so as to hold the saturated suction temperature of compressor 10-4 to a desired lower limit, such as −45° F., by measuring the pressure in suction line 11-4.

In operation, the compressors 10-1 to 10-4 will be operated in response to total demand in the frozen food cases 20-1 to 20-5 and ice cream cases 22-1 and 22-2. Because suction manifold 30 is connected to each of the compressors and each of the frozen food and ice cream cases, any one or combination of the compressors 10-1 to 10-4 may be operating and providing the cooling requirements but, preferably, compressor 10-4 will be running if any compressor is running. The more severe cooling requirements of ice cream cases 22-1 and 22-2 may not be continually met by this arrangement. Responsive to the thermostat 44-1 in ice cream case 22-1 and/or the thermostat 44-2 in ice cream case 22-2 sensing too high of a temperature, controller 50 actuates solenoid 41 causing valve 40 to close. If compressor 10-4 is not already operating, then it is started prior to closing valve 40. Compressor 10-4 is operated at least until thermostats 44-1 and 44-2 are satisfied whereupon solenoid 41 is deactivated and valve 40 opened thereby. Frozen food cases 20-1 to 20-5 may be provided with thermostats also or the pressure may be maintained/-regulated in the suction manifold 30 or the portion thereof serving the frozen food cases. Due to the dual function of compressor 10-4 as both a part of the compressor bank as well as a satellite compressor it is preferred that compressor 10-4 be operated whenever there is a cooling demand. If compressor 10-4 fails, the other compressors, 11-1 to 11-3, will be capable of maintaining the ice cream cases 22-1 and 22-2 below freezing but at possibly a few degrees above the desired temperature of 0° F. Also, compressor 10-3 may be manually switched over to replace a failed compressor 10-4. As illustrated, a bypass line 30-2 extends between suction lines 11-3 and 11-4. Normally open manual valve 33 is connected to suction line 11-3 at a point intermediate suction manifold 30 and the intersection of lines 11-3 and 30-2. Normally closed manual valve 34 is located in line 30-2. Upon the failure of compressor 10-4, if valve 33 is closed and valve 34 is opened, then compressor 10-3 will act in the same manner as compressor 10-4 a described above. Compressor 10-3 should then have a priority of operation as previously described for compressor 10-4.

Although a preferred embodiment of the present invention has been illustrated and described, other changes will occur to those skilled in the art. It is therefore intended that the scope of the present invention is to be limited only by the scope of the appended claims.

What is claimed is:

1. A refrigeration system comprising:

a bank of compressors including a plurality of compressor means connected in parallel between a common suction manifold and a common discharge;

condenser means connected to said discharge;

a plurality of refrigerated compartments with at least one compartment to be maintained at a first temperature and at least one compartment to be maintained at a second temperature which is lower than said first temperature with each of said compartments including an evaporator means;

said evaporator means are connected in parallel with each of said evaporator means being connected to said condenser means through an expansion device and to said common suction manifold;

means in said common suction manifold for dividing said suction manifold into two parts and for selectively blocking fluid communication between said two parts;

all of said evaporator means in said refrigerated compartment to be maintained at said first temperature being connected to a first one of said two parts of said suction manifold;

all of said evaporator means in said refrigerated compartments to be maintained at said second temperature being connected to a second one of said two parts of said suction manifold;

one of said compressor means being connected to said second one of said two parts of said suction manifold and the remaining compressor means being connected to said first one of said two parts of said suction manifold;

means responsive to any of said refrigerated compartments to be maintained at said second temperature being at a temperature above said second temperature for causing said means in said common suction manifold to block fluid communication between said two parts whereby said one of said compressor means acts as a satellite compressor with respect to all of said evaporator means connected to said second one of said two parts of said suction manifold which are thereby maintained at said second temperature.

2. The refrigeration system of claim 1 further including means for restrictedly bypassing said means in said common suction manifold so as to prevent said one compressor means from operating at too low of a temperature.

3. The refrigeration system of claim 1 further including means for connecting a second one of said compressor means to said second one of said two parts of said suction manifold.

* * * * *